United States Patent [19]

Stark

[11] Patent Number: 5,054,449

[45] Date of Patent: Oct. 8, 1991

[54] CCAC (CYLINDER-CONE AIR CHAMBER) CARBURETOR

[76] Inventor: Charles E. Stark, 155 Gass Rd., Pittsburgh, Pa. 15229

[21] Appl. No.: 647,795

[22] Filed: Jan. 30, 1991

[51] Int. Cl.[5] ..... F02M 15/00

[52] U.S. Cl. ..... 123/434; 261/23.2; 123/440

[58] Field of Search ..... 123/434, 439, 435, 440; 261/23.2, 38, 39.2, 40, 41.1, 41.2, DIG. 12, DIG. 39, DIG. 61, DIG. 63; 48/189.4, 190, 199 R, 199 FM

[56] References Cited

U.S. PATENT DOCUMENTS

| | | | |
|---|---|---|---|
| 3,885,539 | 5/1975 | Hicks | 123/435 |
| 4,029,064 | 6/1977 | Csaszar et al. | 123/434 |
| 4,123,233 | 10/1978 | Mannino | 123/434 |
| 4,212,277 | 7/1980 | McLott | 123/434 |
| 4,436,071 | 3/1984 | Hafner et al. | 123/434 |
| 4,526,152 | 7/1985 | Hideg et al. | 123/434 |
| 4,834,050 | 5/1989 | Uranuhi et al. | 123/440 |
| 4,949,692 | 8/1990 | Devine | 123/440 |

*Primary Examiner*—Raymond A. Nelli

[57] ABSTRACT

An improved carburetion process providing improved vaporization and a more uniform distribution of the fuel throughout the entire mass of the intake air stream of an internal combustion engine. A cylinder-cone combination air intake valve replaces the conventional butterfly type. Intermingling of fuel and air takes place in a pre-mix chamber in said cone base prior to exiting via multiple orifices through the cone base perimeter to mix with the main intake air stream. Metering rod control of pre-mix chamber absolute pressures results in variable but precisely controllable fuel/air ratios.

5 Claims, 2 Drawing Sheets

FIG. 1
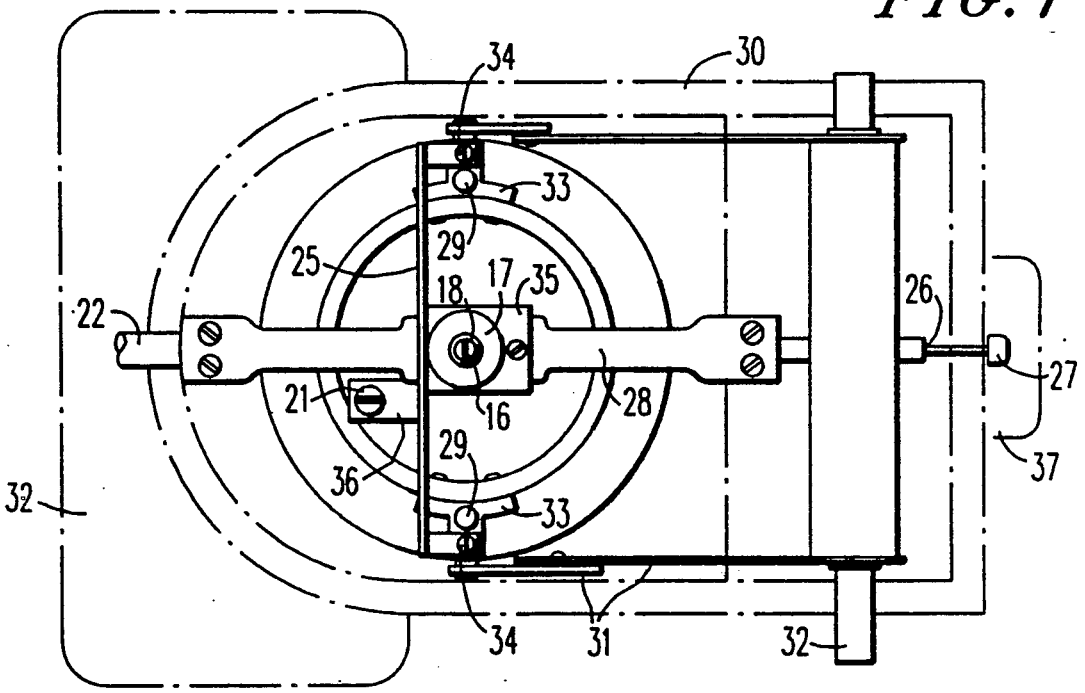
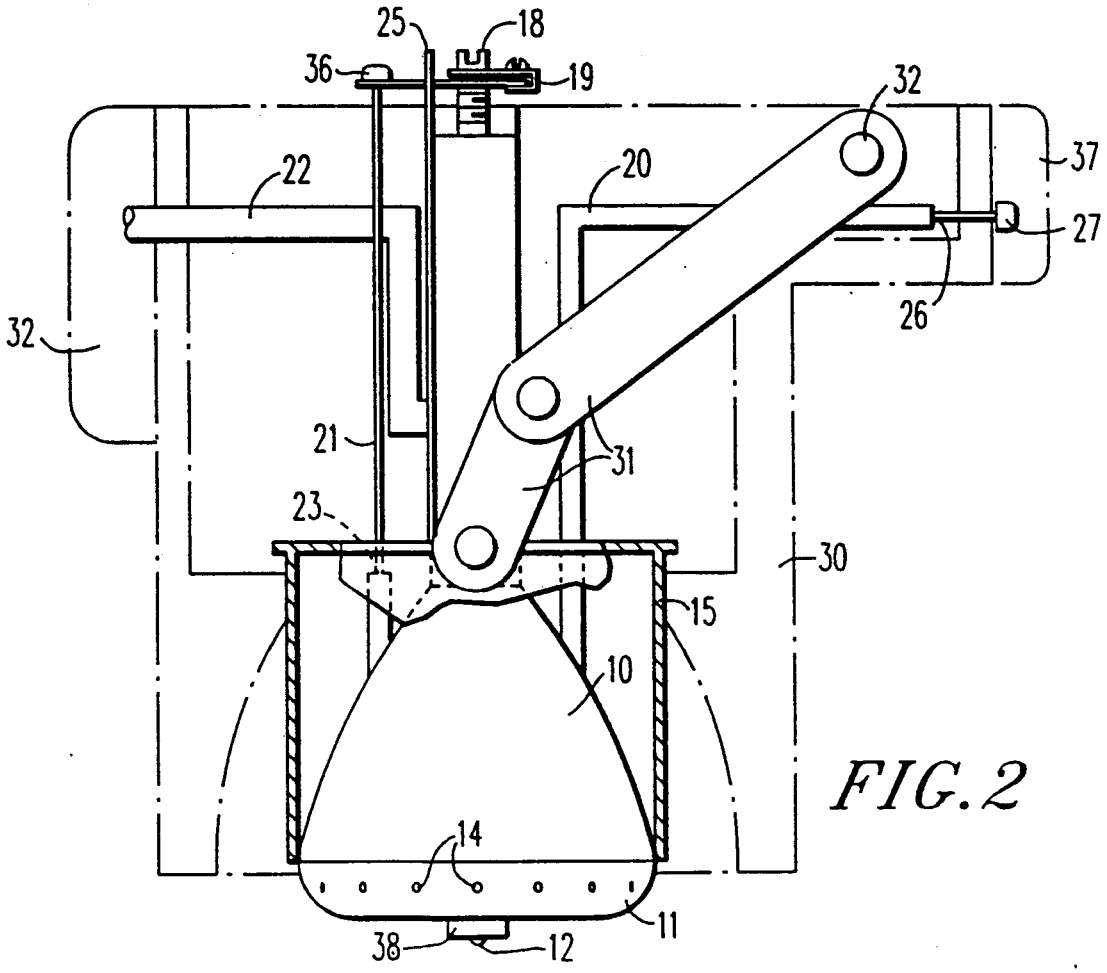
FIG. 2

CCAC (CYLINDER-CONE AIR CHAMBER) CARBURETOR

BACKGROUND OF THE INVENTION

This invention relates to carburetion as applicable to internal combustion engines and more particularly to an improved carburetor which accomplishes better atomization of the fuel leading to thorough vaporization and vastly improved intermingling of the fuel and air at their point of juncture in the carburetor bore. The end result is a leaner fuel air mixture producing more power in an internal combustion engine than has previously been possible to attain. At the same time the process makes possible a readily controllable mixture permitting adjustment over a wide range of fuel/air ratios. The latest state of the art in automobile carburetion generally consisted of a butterfly type throttle valve to control air flow, an idle jet, an off idle jet, a main discharge jet and a power jet to meter fuel. In all four of these states fuel was metered in an almost liquid state at a very restricted area in relation to the cross sectional area of the intake air stream resulting in poor dispersion of fuel throughout the entire intake air mass leading to reduced fuel vaporization. Multi-barreled carburetors were resorted to in an effort to increase fuel dispersion by doubling the venturies and reducing the air intake area surrounding each venturi. In addition to these short comings, the various stages involved led to a less than constant fuel flow curve at all the various possible throttle openings moving from one stage to another. One manufacturer attempted to hold metering rod production dimensions to within 1/10,000 of an inch attempting to arrive at specific fuel/air ratios. When you consider that controlling the quantity of fuel to be metered at a fuel/air ratio of 14.57 to 1 by weight is approximately 10,000 to 1, it is apparent why the problem is so difficult to solve. In today's fuel injected engines, computerized microprocessors have improved the fuel metering process and also the complexity. Liquid fuel is injected under pressure and is finely atomized but it still must. vaporize to burn. Vaporization requires time and manifold travel time exhances the opportunity for vaporization. In addition to this, fuel injection introduces bursts of fuel and as a result does not provided a continuous dispersion of fuel in the intake air stream. This invention is the results fo efforts to address such problems.

In the present invention, the conventional carburetor butterfly type throttle valve has been eliminated. It is replaced by a combination of an eliptically shaped cone and a thin walled cylinder. The cone is held stationary in the center of the carburtor bore by a crossbar and a tube extending downward through the center of the cone. The cylinder's inside dimension is approximately the same size as the largest diameter at the cone base. The outside diameter of the cylinder is a close sliding fit in the carburetor bore at a point above the top of the cone so that when the cylinder is moved fully upward, its base clears the top of the cone proivding an air valve controlling air flow through the carburetor. On the base of the cone, a cap is fastened by a screw thread arrangement. Interfacing portions of the cap and cone are hollowed out to form a cavity or pre-mix chamber. Both fuel and air are drawn into this pre-mix chamber by virtue of the reduced pressure in the (intake manifold. 32 finely drilled orifices in the cone cap perimeter provide access to the pre-mix chamber from the carburetor throat. The volume of fuel and air admitted to the pre-mix chamber is controlled by one fuel metering rod and two air metering rods. The fuel metering rod extending centrally upward from the cone cap into the pre-mix chamber and through the fuel metering tube port provides a coarse control of fuel flow into the pre-mix chamber as this port in the base of the fuel metering tube moves upward in unison with the cylinder air valve admitting increasing amounts of fuel in proportion to the increasing amounts of air admitted to the intake manifold by the cylinder air valve. Idle mixture control is accomplished by adjusting a screw thread arrangement on the upper end of the fuel metering tube which varies the position of the fuel metering tube port in relation to the position of the stationary fuel metering rod and also to the position of the cylinder air valve at its idle position. A primary air metering rod also moving in unison with the cylinder air valve progressively admitts more air to the pre-mix chamber as it is withdrawn from a ported tube leading into the pre-mix chamber thereby maintaining a coarse balance of fuel and air admitted to the pre-mix chamber. A secondary air metering rod moving in a ported tube leading into the pre-mix chamber is externally controlled by an electrically operated thermostatic choke unit providing for cold starts and subsequently controlled by an electrically operated solenoid responding to electric current supplied by an electronic circuit which senses voltage changes supplied by an oxygen sensor. The pulsing of the solenoid operating the secondary air metering rod effectively varies the relative air pressure in the pre-mix chamber thereby providing very minute changes of fuel flow into the pre-mix chamber. It is this control of the relative pressure in the pre-mix chamber that makes possible the precise control of the fuel/air ration. With this mixture of fuel and air in the pre-mix chamber, the fuel in effect is blown out through the large number of orifices in the cone base leading from the pre-mix chamber to the carburetor throat in a spray gun nozzle effect providing finely atomized fuel and superb diffusion throughout the entire mass of the intake air stream as it passes through the carburetor throat. A conventional carburetor float bowl provides a source of fuel and also includes an accelerating pump to insure fuel enrichment for rapid throttle openings. An additional benefit of the cylinder cone air valve combination is that it eliminates atmospheric pressure on moving mechanical components of this carburetor resulting in less wear through use. Accordingly, it is the preferred objective of this invention to provide an improved carburetor that is more economical in the use of fuel, less expensive to manufacture, simpler to service providing equal or better performance than available from the current state of the art. Other objective and advantages of this invention will become apparent from the following detailed description with references being made to accompanying drawings,

BRIEF DESCRIPTION OF THE DRAWINGS

FIG. 1 is a top view of the carburetor looking downward through the carburetor bore.

FIG. 2 is a vertical cross section through the main body of the carburetor with the left side normally facing forward when mounted on a vehicle. No detail is shown of a conventional float bowl chamber located on the left side and represented by 32 on both FIG. 1 and FIG. 2. A conventional accelerating pump is also contained in the float bowl chamber. On the right side of both FIG. 1 and 2 and not shown, 37 represents an electrical solenoid and also an electrically operated thermostatic choke unit which jointly function to control movement of the secondary air metering rod whose function will be described in the descriptive portion of the application.

DESCRIPTION OF THE PREFERRED EMBODIMENTS

Figure 3:
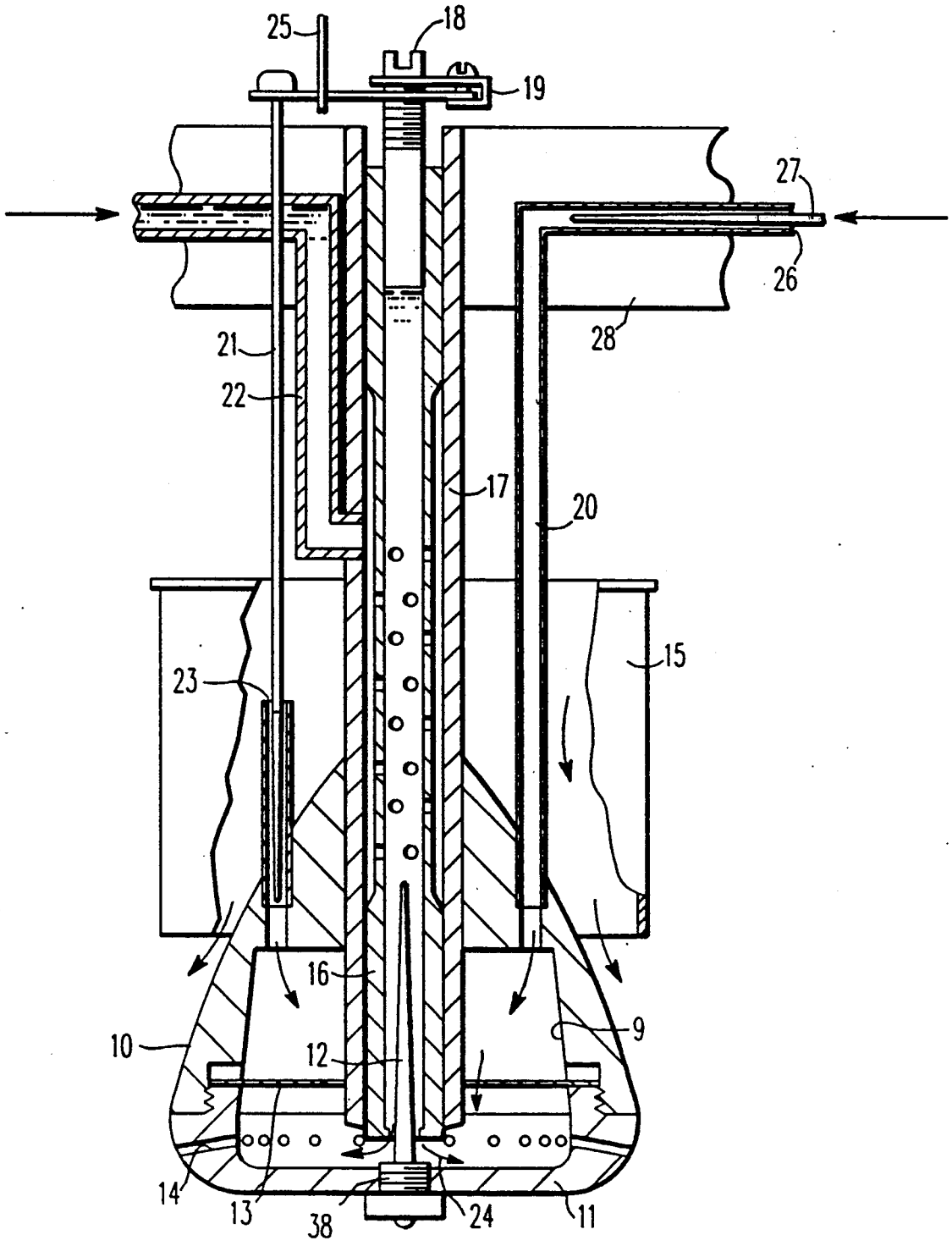
FIG. 3 is an enlarged detailed view of the primary operational components located within the carburetor bore and responsible for the functioning of this carburetor. Also not shown in the drawings is a cast aluminum cover which bolts to the upper surface of the carburetor body and in addition to providing a cover it provides an interfacing surface for attaching an intake air filter to the carburetor.

Referring now to the drawings and particularly FIG. 3, cone 10 and cylinder 15 comprise the main air inlet valve for the carburetor replacing the conventional throttle plate as found in most present day carburetors. Cylinder 15 FIG. 2 is a close sliding fit in carburetor body 30 FIG. 2 and is free to be moved upward from the cone base where it effectively shuts off intake air flow. The cylinder's up and downward movement is controlled by articulated linkage 31 FIG. 2 and throttle actuator shaft 32 FIG. 2. Cylinder fore and aft alignment is controlled by guide pins 29 FIG. 1 which are screwed into the carburetor body and pass through cylinder guide brackets 33 FIG. 1 which brackets are fastened to the outsides of the upper extremity of the cylinder valve 15 FIG. 2. Cone 10 FIG. 3 is supported in the center of the carburetor bore by cone support tube 17 FIG. 3. Cone support tube 17 FIG. 3 extends from the interior of cone 10 FIG. 3 and upward and is fastened in cone support tube crossbar 28 FIG. 3. The cone support tube crossbar 28 FIG. 1 is secured to the main carburetor body 30 FIG. 1 by screws 34 FIG. 1. The vertical curved surface of cone 10 FIG. 3 is eliptical in contour to provide a linear increase in air flow as the cylinder cone throttle valve is opened.

A cavity or pre-mix chamber 9 FIG. 3 is formed by hollowing out portions of the cone cap 11 FIG. 3 and the base of the cone 10 FIG. 3. The cone cap 11 FIG. 3 perimeter is perforated with 32 finely drilled orifices 14 FIG. 3 providing communication between the carburetor bore and the pre-mix chamber 9 FIG. 3. In the center of the cone cap 11 FIG. 3, a threaded plug 38 FIG. 3 supports a fuel metering rod 12 FIG. 3 extending upward into the pre-mix chamber 9 FIG. 3 and continues through the fuel metering tube port 24 FIG. 3 located at the bottom of the fuel metering tube 16 FIG. 3. The fuel metering tube 16 FIG. 3 is a close sliding fit and free to move in the interior of bore of the cone support tube 17 FIG. 3. The fuel metering tube 16 FIG. 3 moves in unison with the cylinder throttle valve 15 FIG. 3 and its movement is controlled by the fuel metering tube actuator yoke 25 FIG. 3 & FIG. 2. The actuator yoke in the form of an inverted "U" is fastened by screws 34 FIG. 1 to cylinder guide brackets 33 FIG. 1 and extends upward and crosses over cone support tube crossbar 28 FIG. 3. A threaded flange 35 FIG. 1 engages threads on the upper end of fuel metering tube 16 FIG. 3 causing it to move in unison with the cylinder throttle valve 15 FIG. 3. A clamp and lock screw 19 FIG. 3 prevents inadvertent movement of the slotted screw head after adjustment since this provides for the idle mixture adjustment as it is screwed minutely up or down in relation to the cylinder throttle valve and at the same time varying the position of the fuel metering tube port 24 FIG. 3 in relation to the position of the stationary fuel metering rod 12 FIG. 3.

A conventional carburetor float bowl provides the source of fuel for this carburetor. In an operating engine, a low pressure is developed in the carburetor bore and this low pressure is communicated to the pre-mix chamber 9 FIG. 3 via the 32 orifices 14 FIG. 3 located in the cone cap. As a result of this low pressure, fuel is drawn from the float bowl and travels into a centrally drilled hole in the forward side of the cone support tube crossbar 28 FIG. 3. Just short of the cone support tube 17 FIG. 3 the fuel is diverted downward by tubing 22 FIG. 3. Approximately midway between the cone support tube crossbar and the upper extremity of the cone 10 FIG. 3, an elbow directs the fuel through the cone support tube 17 FIG. 3 wall. At this point the wall of the fuel metering tube 16 FIG. 3 is reduced in diameter to permit the fuel to flow around it and through multiple drilled holes into its interior. Once in the interior of the fuel metering tube 16 FIG. 3, the fuel travels downward to the fuel metering tube port 24 FIG. 3 surrounding the fuel metering rod 12 FIG. 3 to exit into the pre-mix chamber 9 FIG. 3 where it is now available to be drawn through the 32 orifices 14 FIG. 3 and into the carburetor bore. As the cylinder throttle valve 15 FIG. 3 moves upward from the idle position admitting increasing amounts of air into the carburetor throat, the fuel metering tube port 24 FIG. 3 in the base of the fuel metering tube 16 FIG. 3 also moves upward in unison with the cylinder throttle valve exposing more port area due to the tapering shape of the fuel metering rod 12 FIG. 3 providing increasing amounts of fuel to flow commensurate with the increasing amounts of air admitted by the cylinder throttle valve 15 FIG. 3 into the intake manifold. The fuel now in the pre-mix chamber 9 FIG. 3 is free to pass through the 32 orifices 14 FIG. 3 and mix with the main intake air stream flowing past the base of the cone 10 FIG. 3.

In addition to the fuel admitted to the pre-mix chamber 9 FIG. 3, there are also two air inlet ports admitting air under atmospheric pressure into the pre-mix chamber 9 FIG. 3. One is the primary air inlet port 23 FIG. 3 and the other is the secondary air inlet port 26 FIG. 3. Air flow through the primary air inlet port 23 FIG. 3 is controlled by the primary air metering rod 21 FIG. 3 which moves in unison with the cylinder throttle valve 15 FIG. 3. It is actuated by a flange 36 FIG. 1 located on the fuel metering tube actuating yoke 25 FIG. 3. By varying the dimensions of the taper on the primary air metering rod, the rate of air flow into the pre-mix chamber 9 FIG. 3 can be controlled. As the rate of air flow through the primary air metering port 23 FIG. 3 at a particular throttle setting is increased, the relative absolute pressure in the pre-mix chamber 9 FIG. 3 is raised thereby reducing the rate of fuel flow occurring through the fuel metering port 24 FIG. 3. Controlling the pre-mix chamber relative absolute pressure is the unique and novel process that enables this carburetor to precisely control the fuel/air ratio supplied to an internal combustion engine. The rationale of this is the fact that the larger component of the air/fuel ratio of 10,000 to 1 weight is being varied or controlled. For instance, if 2 parts of fuel is metered instead of 1, the air/fuel ratio drops to 5000 to 1 where as a 500 part plus or minus change in the amount of air admitted changes the ratio from 10,500 or 9,500 to 1 so that the process becomes more readily manageable. An almost unmeasurable change in the dimension of the fuel metering rod 12 FIG. 3 has a profound effect on the fuel/air ration where as relatively large dimensional changes in the primary air metering rod 21 FIG. 3 and secondary air metering rod 27 FIG. 3 has vastly smaller and more manageable effect on the resulting fuel/air ratio. It is the preferred embodiment of this invention to provide a fuel metering rod 12 FIG. 3 which provides a rich mixture throughout the entire throttle range and then tailor the primary air metering rod 21 FIG. 3 taper so that the resulting mixture is just slightly rich. At this point the secondary air metering rod 27 FIG. 3 comes into play. Since the mixture is rich, an oxygen sensor located in the exhaust manifold developes a high voltage output approaching +1.0 volts DC. This causes the associated electronic circuit to feed high current to the solenoid which reacts to withdraw the secondary air metering rod 27 FIG. 3 from secondary port 26 FIG. 3. The secondary air metering rod normally moves toward the closed position under spring tension. In the withdrawal of the secondary air metering rod 27 FIG. 3, more air is admitted through the secondary air metering port 26 FIG. 26 FIG. 3 and via tubing 20 FIG. 3 into the pre-mix chamber 9 FIG. 3. This additional air admitted by the secondary air metering port 26 FIG. 3 causes the relative absolute pressure in the pre-mix chamber 9 FIG. 3 to rise and therefore draw less fuel through the fuel metering tube port 24 FIG. 3 resulting in a leaner mixture which the oxygen sensor located in the exhaust manifold responds to by putting out a lower voltage. By adjusting the electronic circuit voltage reaction threshold to the oxygen sensor output, any mixture ratio within its range of 0 to +1.0 volts DC can be maintained. A voltage output of +0.5 volts DC indicates the desireable reading producing the fewest emissions to meet government standards and also a fuel/air ratio of 14.57 to 1. Within the pre-mix chamber 9 FIG. 3, atomization and intermingling of the fuel and air is enhanced by a baffle plate 13 FIG. 3 which serves to direct the air admitted toward a restricted area surrounding the cone support tube 17 FIG. 3 and slightly above the fuel metering tube port 24 FIG. 3. In passing through this restricted area, it is given direction to flow uniformily radially outward toward the 32 equally spaced orifices 14 FIG. 3 located in the cone 11 FIG. 3. In traveling from the restricted area toward the orifices, the air agitates the fuel that has been admitted by fuel metering tube port 24 FIG. 3, the air mixes with the fuel, the air atomizes the fuel, the air vaporizes the fuel and finally the combination of fuel and air exit the pre-mix chamber via the 32 orifices 14 FIG. 3 in a spray gun nozzle effect to disperse in the main intake air stream flowing around the cone base 10 FIG. 3 and then into the intake manifold.

It is this pre-mix chamber mixing and the high degree of dispersal by the 32 orifices of the fuel and air passing through these orifices to interface with the main intake air stream in the elongated area provided by the circumference of the cone base that is responsible for the consistancy of the mixture as it arrives in the combustion chambers making it possible for an internal combustion engine to operate smoothly and with more power on a leaner mixture than has been possible with the current state of the art carburetors or fuel injection systems.

To provide for cold starting of an engine with this carburetor, the secondary air metering rod 27 FIG. 3 being spring loaded tends to move toward the closed position at all times under control of an electrically operated choke unit. The bi-metal thermostatic spring of the choke reacts to ambient temperature positioning the secondary air metering rod 27 FIG. 3 at a position in the secondary air inlet port 26 FIG. 3 that will furnish an adquately rich mixture for cold starting at that temperature. Once the engine is started, electric current is fed to the electric choke unit, heating and causing it to begin to withdraw the secondary air metering rod 27 FIG. 3 from its associated port and begin the leaning process of the mixture. This withdrawal continues to a predetermined point where an electrical contact opens and further withdrawal ceases. During this time period which is in minutes, the oxygen sensor has heated up to operating temperature, taking approximately 45 seconds. Once the oxygen sensor has reached operating temperature, it takes over control of the fuel/air mixture.

It should be noted in this carburetor that the porcess does not move from one stage to another or admit fuel at one centralized venturi as in a conventional carburetor but is a continuos flow of fuel with only a fine tailoring of that flow being required. Fuel is not metered in bursts as in fuel injection where they are still trying to meter very minute quantities of fuel into the intake air stream at some point explaining why it takes an expensive and complicated microprocessor to accomplish the objective.

What I claim is:

1. A carburetion process for internal combustion engines comprising in combination, a cylinder-cone air intake valve controlling the main intake air flow through a carburetor bore, a pre-mix chamber or cavity in the base of said cone, said pre-mix chamber acting as a controlled pressure chamber into which controlled amounts of both fuel and air are admitted by a combination of ports and tapered metering rods resulting in the controllability of the absolute pressure in the pre-mix chamber, said pressure control thereby regulating the rate of fuel admitted to the pre-mix chamber through the fuel metering tube port and at the same time providing for the positive intermingling of fuel and air, said intermingling being enhanced by a circular baffle plate which directs the air flow from a constricted area surrounding the centrally located cone support tube and directing it outward toward the 32 equally spaced orifices radiating outward through the cone cap wall to communicate with the main carburetor bore at which point the fuel driven by air through the orifices in a spray nozzle effect interfaces with the main intake air stream as admitted by the cylinder throttle valve resulting in a high degree of despersion of fuel throughout the entire mass of the intake air stream by virtue of its distribution by the 32 orifices, thereafter passing into the intake manifold, said process taking place continuously throughout all throttle settings using the same metering components.

2. A cylinder cone air intake valve as stated in claim 1 in which the cylinder cone combination effectively eliminates the atmospheric pressure on the mechanically operating components due to the substantial pressure differential existing at closed and partial throttle openings since the pressure is dissipated on the stationary cone and outwardly on the interior walls of the cylindrical throttle valve thereby reducing the necessary operating force, reducing operational wear and adding to the operational life of the carburetor.

3. A carburetion process as stated in claim 1 in which the pre-mix chamber acts as a controlled pressure chamber in relation to the absolute pressure in the intake manifold resulting in fuel being drawn through the fuel metering tube port into the pre-mix chamber which port moves in unison with the cylindrical throttle valve, said fuel flow through the fuel metering tube port being primarily controlled by a tapering fuel metering rod projecting upward from the center of the cone cap base and through the fuel metering tube port, said absolute pressure in the pre-mix chamber being controlled by both a primary and a secondary air metering port and their corresponding air metering rods controlling air flow into the pre-mix chamber, a primary air metering rod being readily and externally interchangeable for rods of varying taper dimensions, moves in unison with the cylinder throttle valve progressively admitting more air as the throttle is opened to balance the increased fuel flow through the fuel metering tube port, a secondary air metering rod being externally controlled by an electrically operated choke control unit responding to ambient temperature providing a rich mixture for cold starts as a result of its bi-metal thermostatic action, said secondary air metering rod being also controlled by a solenoid responding to electrical current supplied by an electronic circuit which responds to voltages generated by an oxygen sensor located in the exhaust manifold thereby providing a fine tuning of the pre-mix chamber absolute pressure resulting in precise control of the fuel/air ratio.

4. The primary air metering rod as specified in claim 3 moving upward in unison with the cylindrical throttle air intake valve progressively exposes more port area for the admission of atmospheric air to the pre-mix chamber as the throttle is advanced suppling more air to balance the increased fuel flow through the fuel metering tube port, said primary air metering rod being readily interchangeable for ones of varying taper dimensions providing for alteration of the pre-mix chamber pressure and thereby modifying the fuel/air ratio as desired to obtain optimum or preferential mixtures, the preferred embodiment being a rod providing a slightly rich mixture so that the secondary externally controlled air metering rod can provide a precisely controlled fuel/air ratio meeting emission control standards or other desireable fuel/air ratios.

5. A secondary externally controlled air metering rod as specified in claim 3 admits air into and alters pre-mix chamber pressure under control of an electric type choke unit for cold starting at which time the secondary air metering rod approaches the closed position and is also controlled by a solenoid acting in response to electrical current supplied by an electronic circuit which responds to voltages generated by an oxygen sensor located in the exhaust manifold, said control progressing from a rich to a leaner mixture as the units become active, i.e. as the choke thermostat becomes heated, it causes the secondary air metering rod to move outward admitting more air to the pre-mix chamber increasing its absolute pressure resulting in a leaning of the mixture, also as the oxygen sensor developes higher voltage, the the solenoid current is increased by the electronic circuit causing the secondary air metering rod to move outward admitting additional air to the pre-mix chamber increasing its absolute pressure resulting in a leaning of the mixture which then causes a drop in the oxygen sensor voltage output, a reduction in electrical current flow to the solenoid, a retraction of the secondary air metering rod which then enriches the mixture and finally stablizing at a predetermined voltage of approximately +0.5 volts DC to provide a fuel/air ratio of 14.57 to 1 resulting in minimum exhaust emissions when the electronic circuit is adjusted to this particular threshold value.

* * * * *